US007009588B2

(12) United States Patent
Lee et al.

(10) Patent No.: US 7,009,588 B2
(45) Date of Patent: Mar. 7, 2006

(54) DEVICE AND METHOD FOR DRIVING PLASMA DISPLAY PANEL

(75) Inventors: Jun-Young Lee, Cheonan (KR); Jin-Sung Kim, Anyang (KR); Hak-Ki Choi, Cheonan (KR); Chan-Young Han, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 394 days.

(21) Appl. No.: 10/615,519

(22) Filed: Jul. 7, 2003

(65) Prior Publication Data

US 2004/0075626 A1 Apr. 22, 2004

(30) Foreign Application Priority Data

Jul. 23, 2002 (KR) ..... 10-2002-0043254

(51) Int. Cl.
*G09G 3/28* (2006.01)
*G09G 3/10* (2006.01)

(52) U.S. Cl. ..... 345/68; 315/169.4

(58) Field of Classification Search ..... 345/60–72, 345/211–213; 315/169.1, 169.4
See application file for complete search history.

(56) References Cited

U.S. PATENT DOCUMENTS 4,866,349 A 9/1989 Weber et al.
5,081,400 A 1/1992 Weber et al.
6,160,531 A * 12/2000 Chen et al. ..... 345/60
6,175,192 B1 * 1/2001 Moon ..... 315/169.3
6,583,575 B1 * 6/2003 Roh et al. ..... 315/169.1
6,617,802 B1 * 9/2003 Roh ..... 315/169.4
6,768,270 B1 * 7/2004 Chae ..... 315/169.3
6,803,888 B1 * 10/2004 Nakamura et al. ..... 345/60
2003/0006712 A1 * 1/2003 Chae et al. ..... 315/169.1

FOREIGN PATENT DOCUMENTS

JP 11-85099 3/1999

OTHER PUBLICATIONS

Patent Abstract of Japan 11-085099, Published Mar. 30, 1999, in the name of Nagai.

* cited by examiner

*Primary Examiner*—Xiao Wu
*Assistant Examiner*—M. Fatahiyar
(74) *Attorney, Agent, or Firm*—Christie, Parker and Hale, LLP

(57) ABSTRACT

In a PDP driver, first and second signal lines for a voltage of Vs and third and fourth signal lines for a voltage of 0V are formed. While maintaining Y and X electrodes of the panel capacitor at Vs and 0V, a first current path is formed from the first signal line to the fourth signal line through an inductor to supply a first-directional current to the inductor. A second current path is formed from the Y electrode to the X electrode through the inductor to change the Y and X electrode voltages using the resonance. When the electrode voltages become 0V and Vs, a third current path is formed from the third signal line to the second signal line through the inductor to reduce the first-directional current.

12 Claims, 7 Drawing Sheets

DEVICE AND METHOD FOR DRIVING PLASMA DISPLAY PANEL

CROSS REFERENCE TO RELATED APPLICATION

This application claims priority to and the benefit of Korea Patent Application No. 2002-43254 filed on Jul. 23, 2002 in the Korean Intellectual Property Office, the content of which is incorporated herein by reference.

BACKGROUND OF THE INVENTION (a) Field of the Invention

The present invention relates to a device and method for plasma display panels (PDPs). More specifically, the present invention relates to a PDP sustain-discharge circuit.

(b) Description of the Related Art

Recently, liquid crystal displays (LCDs), field emission displays (FEDs), and PDPs have been actively developed. From among the flat panel devices the PDPs have better luminance and light emission efficiency compared to the other types of flat panel devices, and also have wider view angles. Therefore, PDPs have come into the spotlight as substitutes for the conventional cathode ray tubes (CRTs) in large displays of greater than 40 inches.

The PDP is a flat display that uses plasma generated via a gas discharge process to display characters or images, and tens to millions of pixels are provided thereon in a matrix format, depending on its size. PDPs are categorized into DC PDPs and AC PDPs, according to supplied driving voltage waveforms and discharge cell structures.

Since the DC PDPs have electrodes exposed in the discharge space, they allow the current to flow in the discharge space while the voltage is supplied, and therefore they problematically require resistors for current restriction. On the other hand, since the AC PDPs have electrodes covered by a dielectric layer, capacitances are naturally formed to restrict the current, and the electrodes are protected from ion shocks in the case of discharging. Accordingly, they have a longer lifespan than the DC PDPs.

In general, a method for driving the AC PDP includes a reset period, an addressing period, and a sustain period. In the reset period, the states of the respective cells are reset in order to smoothly address the cells. In the addressing period, cells that are turned on and the cells that are not turned on in a panel are selected, and wall charges are accumulated in the cells that are turned on (i.e., the addressed cells). In the sustain period, discharge is performed in order to actually display pictures on the addressed cells. When it comes to the sustain period, sustain-discharging pulses are alternately applied to the scan electrodes and the sustain electrodes to sustain the display of the image. In the erase period, the wall charges of the cells are reduced to terminate the sustain period.

In the AC PDP, because scan electrodes and sustain electrodes operate as a capacitive load, capacitance with respect to the scan electrodes and sustain electrodes exists, and the panel is equivalently expressed as a panel capacitor. Reactive power other than power for discharge is necessary in order to apply waveforms for the sustain period to the panel capacitor. Hence, a sustain-discharge circuit includes a power recovery circuit for recovering the reactive power and re-using the same.

L. F. Weber has disclosed a sustain-discharge circuit in U.S. Pat. Nos. 4,866,349 and 5,081,400. The sustain-discharge circuit by Weber includes a power recovery capacitor so that the energy of the panel capacitor is recovered to the power recovery capacitor or the energy charged to the power recovery capacitor is delivered to the panel capacitor, because of the resonance caused by the panel capacitor and an inductor.

In the conventional power recovery circuits, however, it is required to always charge the power recovery capacitor by a half of the sustain-discharging voltage immediately after the light has emitted, and when this is not done, a very large inrush current may be generated when a sustain-discharging pulse begins. Further, 100% energy recovery is impossible due to a turn-on loss of switches and a loss of the circuit itself, such as a switching loss during the recovery process. Hence, a terminal voltage of the panel capacitor may not be increased to the sustain-discharging voltage or decreased to a ground voltage, and accordingly, the switches fail to perform zero voltage switching, but perform hard switching, thereby generating unnecessary power loss and adding stress to the switches. Since the conventional sustain-discharge circuit has a long rising time and falling time of the terminal voltage at the panel capacitor, the discharge may be generated during a rising or falling period of the terminal voltage at the panel capacitor.

SUMMARY OF THE INVENTION

In accordance with the present invention a PDP driving circuit for reducing stress of elements and also decreasing rising time and falling time of sustain-discharging pulses is provided. The present invention couples an inductor between a Y electrode and an X electrode of the panel capacitor when the terminal voltage at the panel capacitor is changed.

In one aspect of the present invention, a device for driving a PDP having a plurality of first electrodes and second electrodes arranged in pairs, and a panel capacitor formed between the first electrode and the second electrode, includes a first switch and a second switch coupled in series between a first power source and a second power source for respectively supplying a first voltage and a second voltage. A common point of the first and second switches are coupled to a first end of the panel capacitor. A third switch and a fourth switch are coupled in series between the first power source and the second power source. A common point of the third switch and the fourth switch are coupled to a second end of the panel capacitor. An inductor is coupled to the first end of the panel capacitor. A fifth switch and a sixth switch are coupled in parallel between the inductor and the second end of the panel capacitor, wherein the current is supplied to the inductor because of a path formed among the first power source, the inductor, and the second power source, and voltages at both ends of the panel capacitor are concurrently changed because of the resonance generated by the panel capacitor and the inductor while the current is applied to the inductor.

The difference between the first voltage and the second voltage is a voltage needed for sustain-discharging the PDP.

In another aspect of the present invention, a device for driving a PDP having a plurality of first electrodes and second electrodes arranged in pairs, and a panel capacitor formed between the first electrode and the second electrode, includes an inductor coupled to a first end of the panel capacitor, a first signal line and a second signal line for supplying a first voltage. A third signal line and a fourth signal line supply a second voltage. A first current path, formed from the first signal line to the fourth signal line through the indictor, supplies the current in the first direction to the inductor while a first end and a second end of the panel capacitor are substantially maintained at the first voltage and the second voltage, respectively. A second current path, is formed from the first end of the panel capacitor to the second end of the panel capacitor through the inductor, for changing voltages at both ends of the panel capacitor because of the current in the first direction and the resonance provided between the panel capacitor and the inductor. A third current path is formed in order of the third signal line, the inductor, and the second signal line so as to reduce the current in the first direction when the first end and the second end of the panel capacitor become the second voltage and the first voltage, respectively.

The first end and the second end of the panel capacitor are respectively coupled to the third and the second signal lines when the voltages at the first end and the second end of the panel capacitor become the second voltage and the first voltage, respectively.

In still another aspect of the present invention, a method for driving a PDP having a plurality of first electrodes and second electrodes arranged in pairs, a panel capacitor formed between the first electrode and the second electrode, an inductor coupled to a first end of the panel capacitor, and a first power source and a second power source for respectively supplying a first voltage and a second voltage, is provided. Current in a first direction is supplied through the voltage difference between the first power source and the second power source to store a first energy when the voltages at a first end and a second end of the panel capacitor are substantially maintained at the first voltage and the second voltage, respectively. Voltages at the first end and the second end of the panel capacitor are changed to the second voltage and the first voltage respectively, by using the resonance generated in the path formed from the first end of the panel capacitor to the second end of the panel capacitor through the inductor, and using the first energy. The first end and the second end of the panel capacitor are maintained to substantially be the second voltage and the first voltage, respectively, and the energy remaining in the inductor to the first power source is recovered.

DETAILED DESCRIPTION

Figure 1:
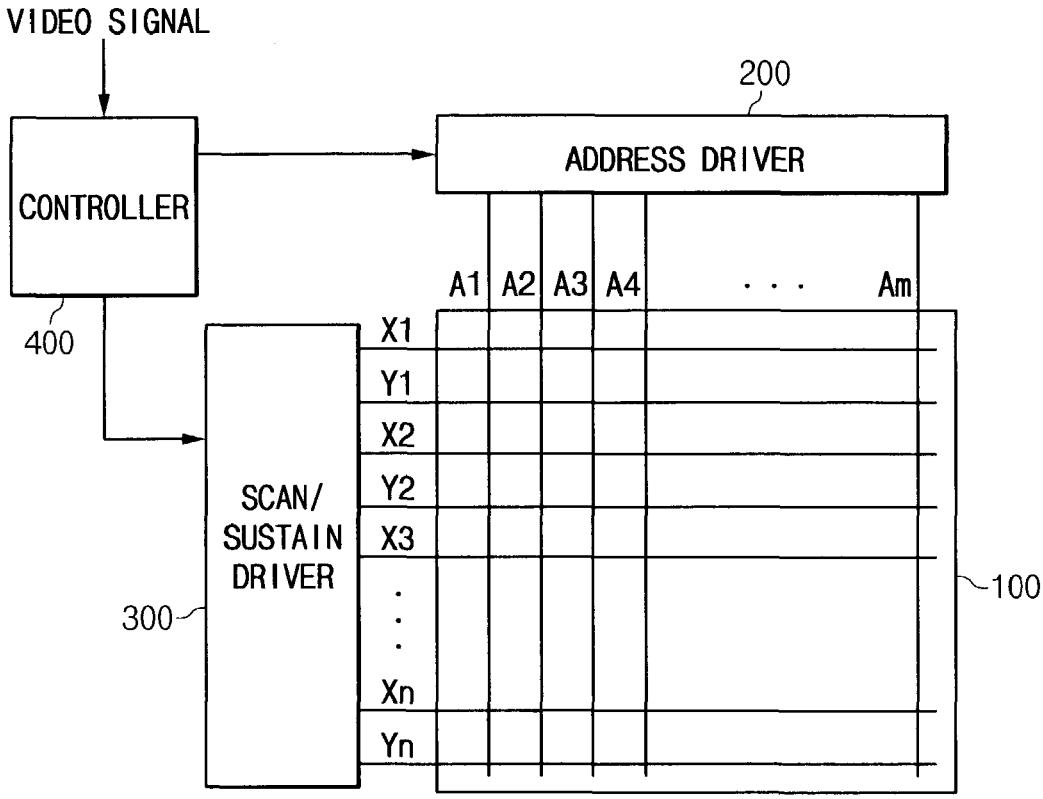
FIG. 1 shows a PDP according to an embodiment of the present invention.

FIG. 1 shows a PDP according to an embodiment of the present invention which includes plasma panel 100, address driver 200, scan and sustain driver 300, and controller 400.

Plasma panel 100 includes a plurality of address electrodes A1 through Am arranged in the column direction, and a plurality of scan electrodes Y1 through Yn and sustain electrodes X1 through Xn alternately arranged in the row direction. Address driver 200 receives an address driving control signal from controller 400, and applies a display data signal for selecting a discharge cell to be displayed to respective address electrodes A1 through Am. Scan and sustain driver 300 includes a sustain-discharge circuit for receiving a sustain driving control signal from controller 400, and alternately applies sustain-discharging pulses to scan electrodes Y1 through Yn and sustain electrodes X1 through Xn to sustain the selected discharge cells. Controller 400 externally receives a video signal, generates an address driving control signal and a sustain driving control signal, and respectively applies them to address driver 200 and scan and sustain driver 300.

Figure 2:
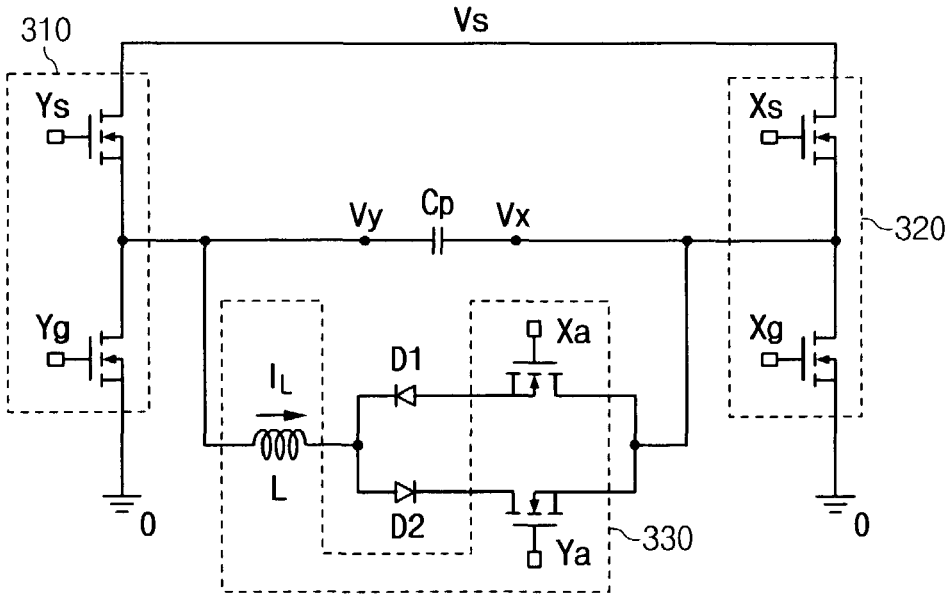
FIG. 2 shows a sustain-discharge circuit of the PDP according to an embodiment of the present invention.
Figure 3A:
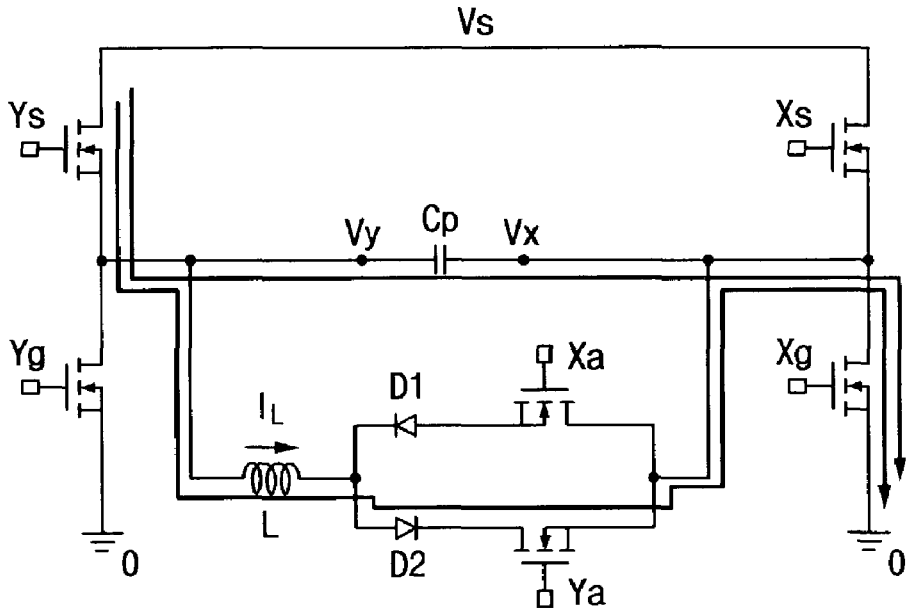
FIGS. 3A through 3H respectively show a current path of each mode in the sustain-discharge circuit according to an embodiment of the present invention.
Figure 3B:
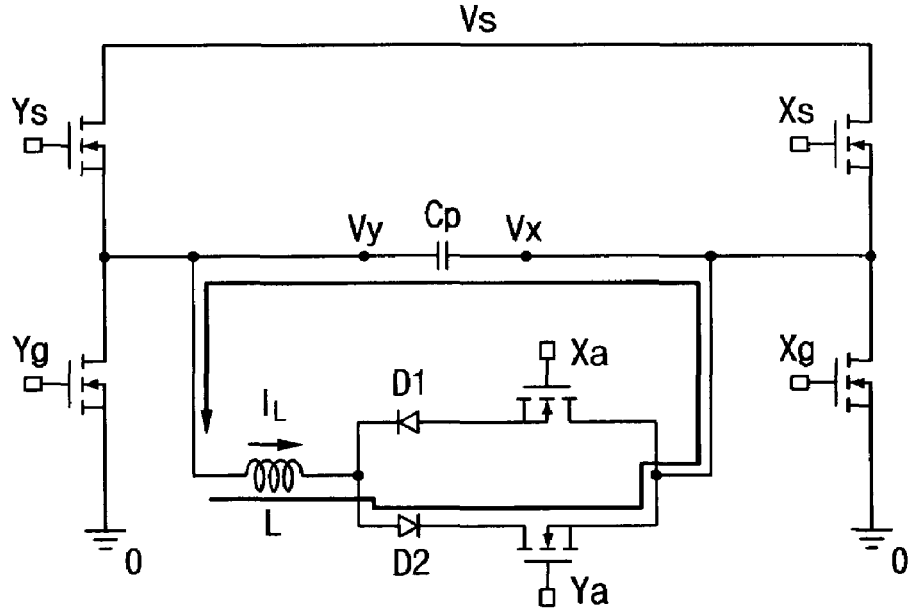
Figure 3C:
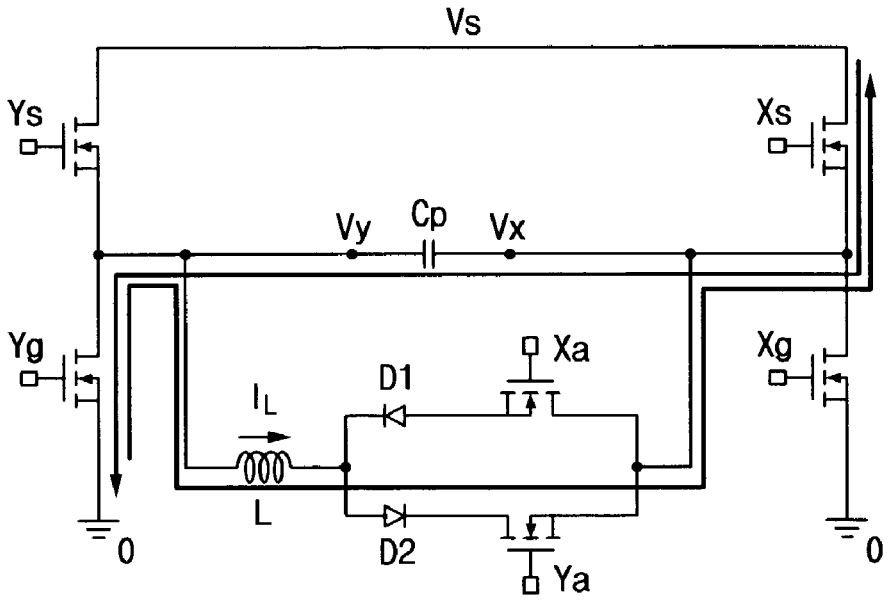
Figure 3D:
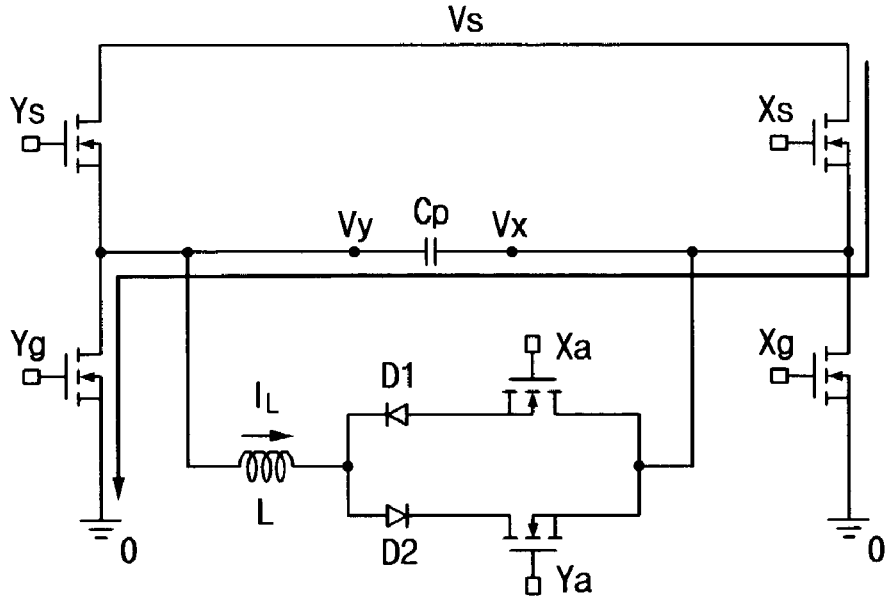
Figure 3E:
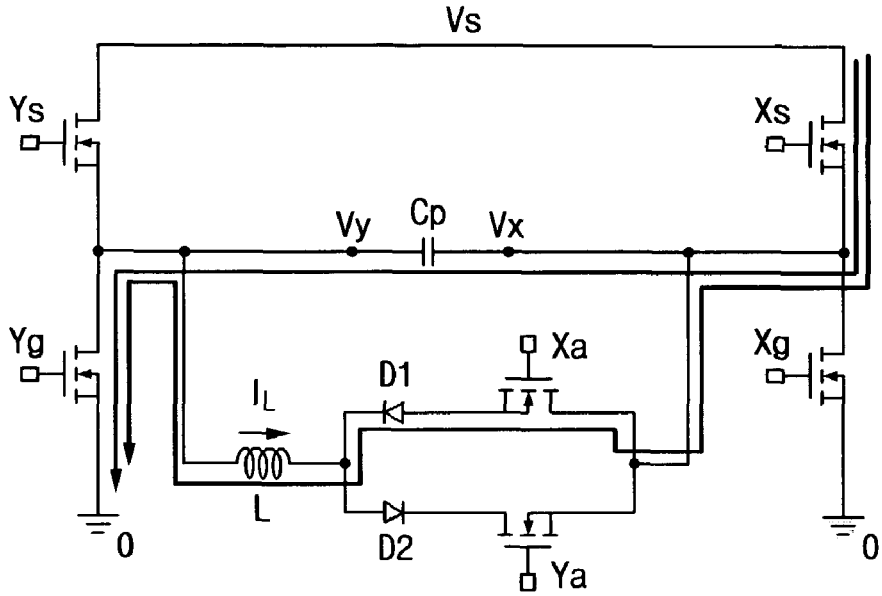
Figure 3F:
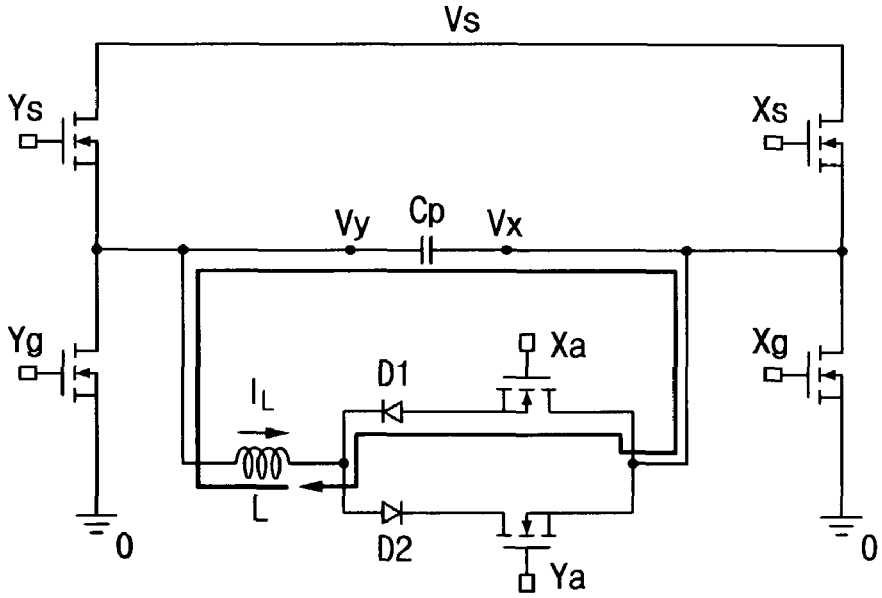
Figure 3G:
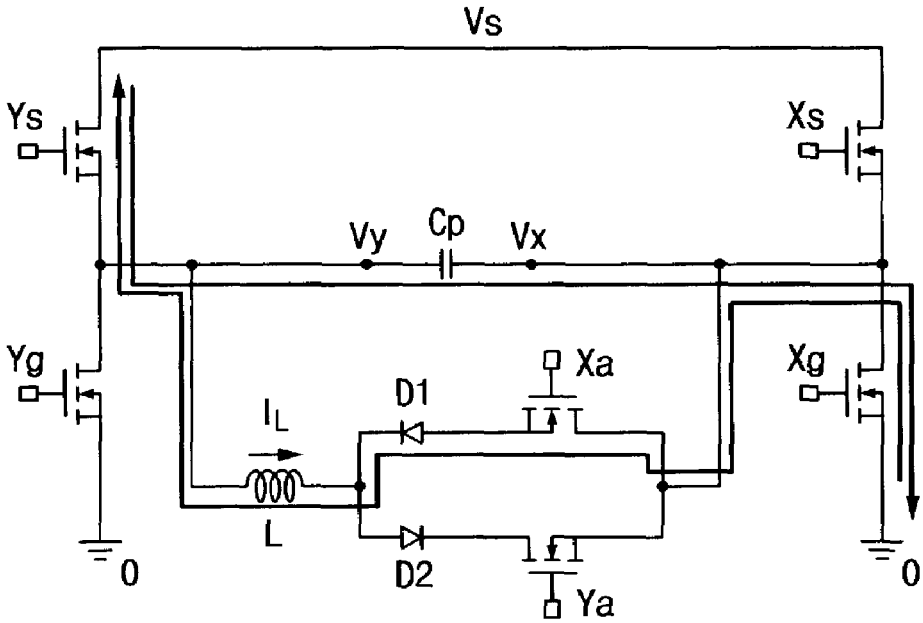
Figure 3H:
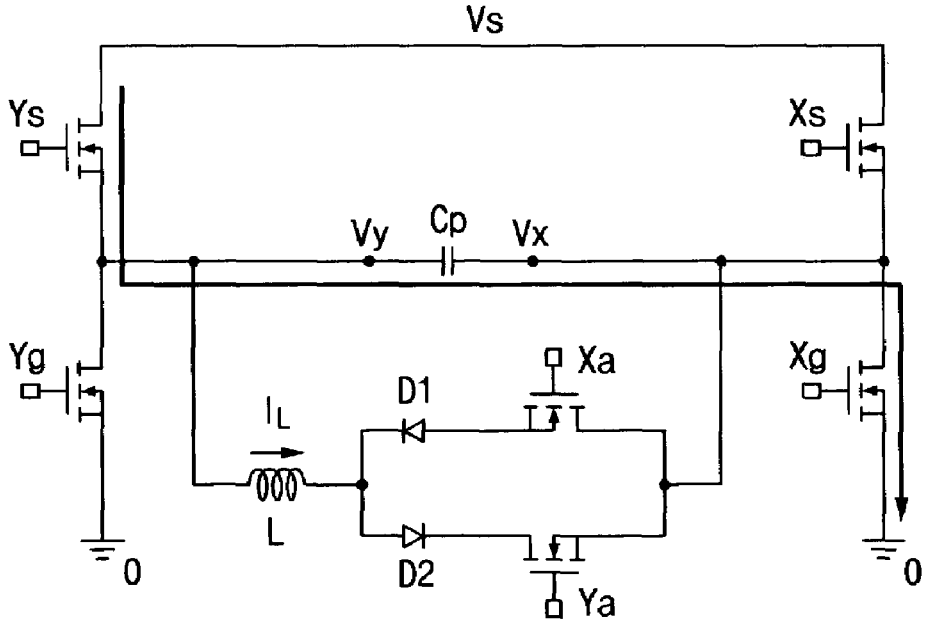
Figure 4:
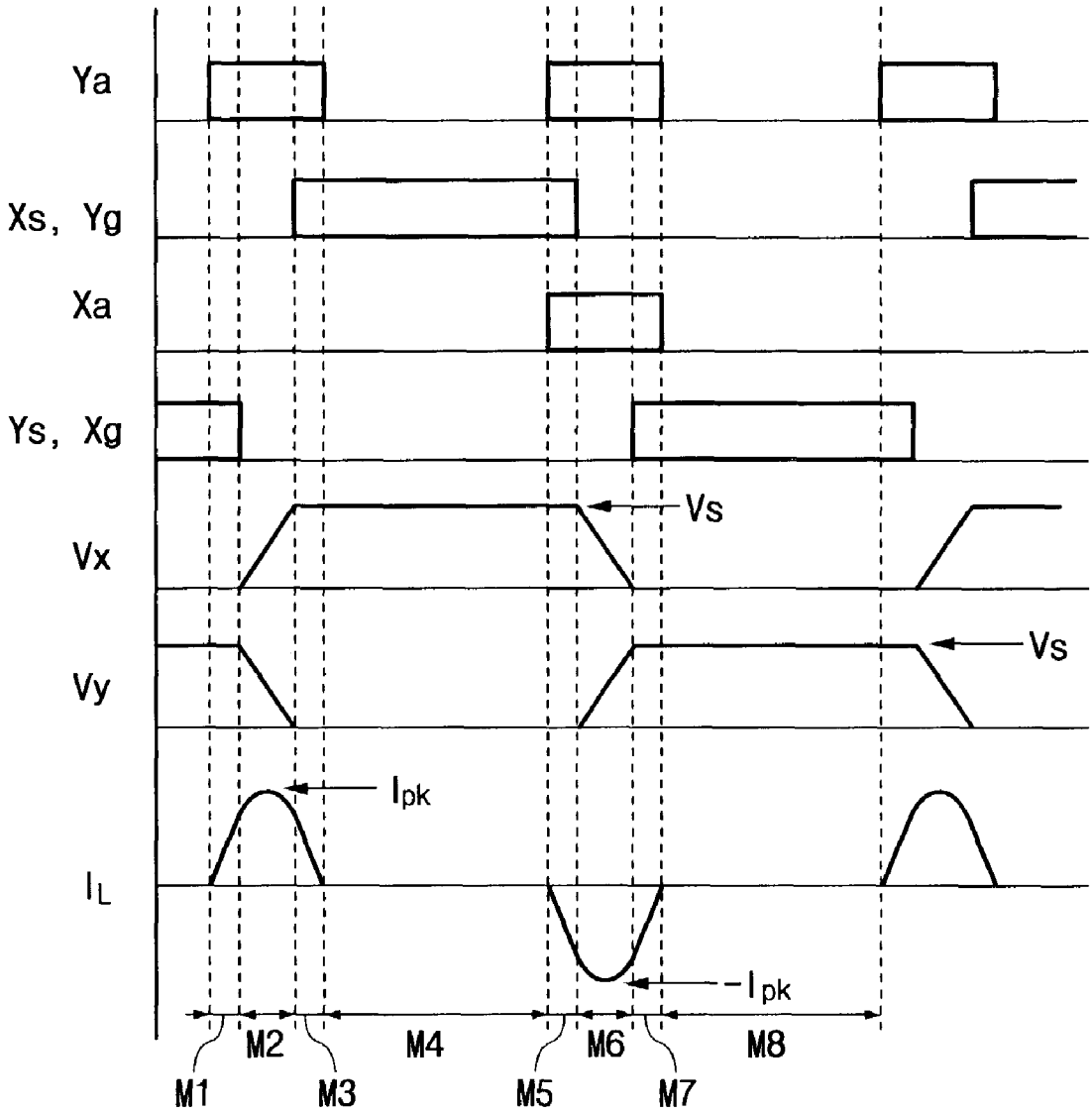
FIG. 4 shows an operational timing diagram of the sustain-discharge circuit according to an embodiment of the present invention.

Referring to FIGS. 2 through 4, a sustain-discharge circuit according to an embodiment of the present invention will be described. FIG. 2 shows a sustain-discharge circuit of the PDP. FIGS. 3(*a*) through 3(*h*) respectively show a current path of each mode in the sustain-discharge circuit. FIG. 4 shows an operational timing diagram of the sustain-discharge circuit.

As shown in FIG. 2, the sustain-discharge circuit includes Y electrode driver 310, X electrode driver 320, and resonator 330. Y electrode driver 310 and X electrode driver 320 are coupled to a Y electrode and an X electrode of panel capacitor Cp. Y electrode driver 310 includes switches Ys and Yg, and X electrode driver 320 includes switches Xs and Xg. Resonator 330 includes inductor L and switches Xa and Ya. Referring to FIG. 2, switches Ys, Yg, Ya, Xs, Xg, and Xa represent MOSFETs, but without being restricted to them. Any switches that perform identical or similar function may also be used. It is desirable for switches Ys, Yg, Ya, Xs, Xg, and Xa to have body diodes.

Switches Ys and Yg are coupled between power source Vs for supplying a voltage of Vs and ground, and a common point of switches Ys and Yg is coupled to the Y electrode of panel capacitor Cp. Switches Xs and Xg are coupled in series between power source Vs and ground, and a common point of switches Xs and Xg is coupled to the X electrode of panel capacitor Cp. Inductor L is coupled to the Y electrode of panel capacitor Cp, and switches Xa and Ya are coupled in parallel between inductor L and the X electrode of panel capacitor Cp. In this instance, diodes D1 and D2 may further be added between inductor L and switches Xa and Ya, respectively. Diodes D1 and D2 cut the current that may flow because of the body diodes of switches Xa and Ya. Since the actual circuit has a parasitic component, a diode (not illustrated) for clamping the voltage between the inductor and switches Xs and Xg to the voltage of Vs or 0 volts is provided.

In FIG. 2, inductor L is coupled to the Y electrode of panel capacitor Cp, and further, inductor L may be coupled to the X electrode of panel capacitor Cp, and in this instance, switches Xa and Ya are coupled to the Y electrode of panel capacitor Cp.

The above-noted operation of the sustain-discharge circuit will be described in detail with reference to FIGS. 3A through 3H and 4.

Referring to FIGS. 3A and 4, in mode 1(M1), switches Ys and Xg are turned on to maintain the Y and X electrode voltages of panel capacitor Cp to be Vs and 0V, respectively. In this state, switch Ya is turned on to form a current path in order of power source Vs, switch Ys, inductor L, diode D2, switches Ya and Xg, and ground. Because of the current path, current IL flowing to inductor L has a gradient of Vs/L and linearly increases to store energy in inductor L.

Next, in mode 2(M2), switches Ys and Xg are turned off while switch Ya is turned on. As shown in FIG. 3B, current IL flowing to inductor L then flows in the path of inductor L, diode D2, switch Ya, and panel capacitor Cp to generate a resonance between inductor L and panel capacitor Cp. The resonance reduces voltage Vy at the Y electrode of panel capacitor Cp, and increases voltage Vx at the X electrode. As shown in FIG. 4, current IL flowing to inductor L because of the resonance rises to maximum value Ipk, and then it reduces. In this instance, since the resonance is generated while the energy is previously charged to inductor L in mode 1(M1), voltages Vy and Vx at the Y and X electrodes may be changed to 0V and Vs, respectively.

In mode 3(M3), the body diodes of switches Yg and Xs are turned on so that voltages Vy and Vx at the Y and X electrodes of panel capacitor Cp respectively become 0V and Vs. As shown in FIG. 3C, current IL flowing to inductor L flows in order of the body diode of switch Yg, inductor L, diode D2, switch Ya, and the body diode of switch Xs, and accordingly, current IL linearly reduces with the gradient of −Vs/L. That is, the current flowing to inductor L is recovered to power source Vs. Switches Yg and Xs are turned on to maintain voltages Vy and Vx at the Y and X electrodes of panel capacitor Cp to be 0V and Vs, respectively. In this instance, since switches Yg and Xs perform zero voltage switching while turning on while the voltage between a drain and a source is 0 volts, no turning-on loss of switches Yg and Xs is generated.

In mode 4(M4), switch Ya is turned off when current IL flowing to inductor L becomes 0 A. The voltages at the Y and X electrodes of panel capacitor Cp are maintained at 0V and Vs, respectively, as shown in FIG. 3D, since switches Yg and Xs are continuously turned on.

Referring to FIGS. 3E and 4, in mode 5(M5), while the voltages at the Y and X electrodes of panel capacitor Cp are maintained at 0V and Vs respectively, switch Xa is turned on to form a current path in order of power source Vs, switches Xs and Xa, diode D1, inductor L, switch Yg, and ground. Because of the current path, current IL flowing to inductor L flows in the opposite direction of the direction of mode 1(M1), and it linearly increases with a gradient of Vs/L to thereby charge the energy to inductor L.

Next, in mode 6(M6), switches Yg and Xs are turned off while switch Xa is turned on. Current IL flowing to inductor L flows to the path in order of inductor L, panel capacitor Cp, switch Xa, and diode D1 as shown in FIG. 3F, and accordingly, a resonance is generated between inductor L and panel capacitor Cp. Because of the resonance, voltage Vy at the Y electrode of panel capacitor Cp increases, and voltage Vx at the X electrode decreases. As shown in FIG. 4, current IL flowing to inductor L rises to maximum value −Ipk, and falls again. Since the resonance is generated while the energy is stored in inductor L in mode 5(M5), voltages Vy and Vx at the Y and X electrodes may be respectively changed to Vs and 0V when the sustain-discharge circuit has a parasitic component.

In mode 7(M7), the body diodes of switches Ys and Xg are turned on so that voltages Vy and Vx at the Y and X electrodes of capacitor Cp respectively become Vs and 0V. As shown in FIG. 3G, current IL flowing to inductor L flows to the body diode of switch Xg, switch Xa, diode D1, inductor L, and the body diode of switch Ys, and hence, the current linearly reduces with the gradient of −Vs/L. That is, the current flowing to inductor L is recovered to power source Vs. Switches Ys and Xg are turned on to maintain voltages Vy and Vx at the Y and X electrodes of panel capacitor Cp to be Vs and 0V, respectively. In this instance, since switches Ys and Xg perform zero voltage switching, no turning-on switching loss by switches Ys and Xg is generated.

When current IL flowing to inductor L becomes 0 A, switch Xa is turned off in mode 8(M8). Since switches Yg and Xs are turned on, the voltages at the Y and X electrodes of panel capacitor Cp are respectively maintained at Vs and 0V, as shown in FIG. 3H.

By repeating mode 1 through mode 8, sustain-discharging pulses swinging between Vs and 0V may be applied to the Y and X electrodes of panel capacitor Cp.

Since the resonance is generated while the energy is charged to the inductor in modes 5 and 8 in the embodiment of the present invention, the zero voltage switching may be performed when the circuit has a parasitic component. Also, since the resonance is generated while the current flows to the inductor, the rising time or the falling time of the voltages at the Y and X electrodes of panel capacitor Cp becomes shorter.

Figure 5:
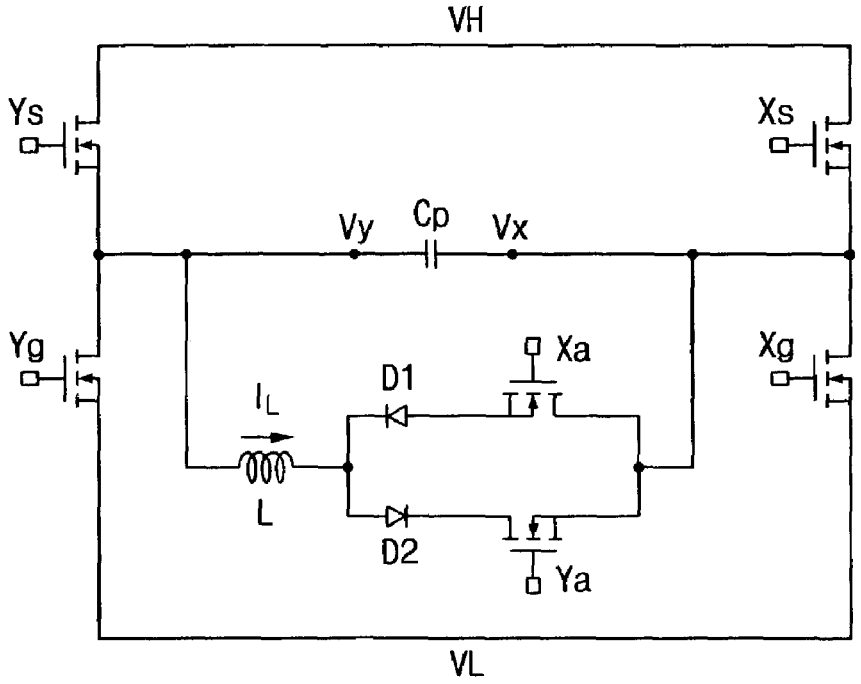
FIG. 5 shows a PDP sustain-discharge circuit according to another embodiment of the present invention.

In the embodiment of the present invention as shown in FIG. 2, voltage Vs and the ground voltage are used as power sources in order for the voltages at the Y and X electrodes of panel capacitor Cp to swing between Vs and 0V. In another embodiment of the present invention, as shown in FIG. 5, power source VH for supplying voltage VH and power source VL for supplying voltage VH-Vs are used. Switches Ys and Xs are coupled to power source VH, and switches Yg and Xg are coupled to power source VL. Accordingly, voltages VH and VH-Vs are alternately applied to the Y and X electrodes of panel capacitor Cp, and the voltage difference between the Y and X electrodes becomes voltage Vs, and hence, the voltage needed for the sustain period may be applied to panel capacitor Cp.

Figure 6:
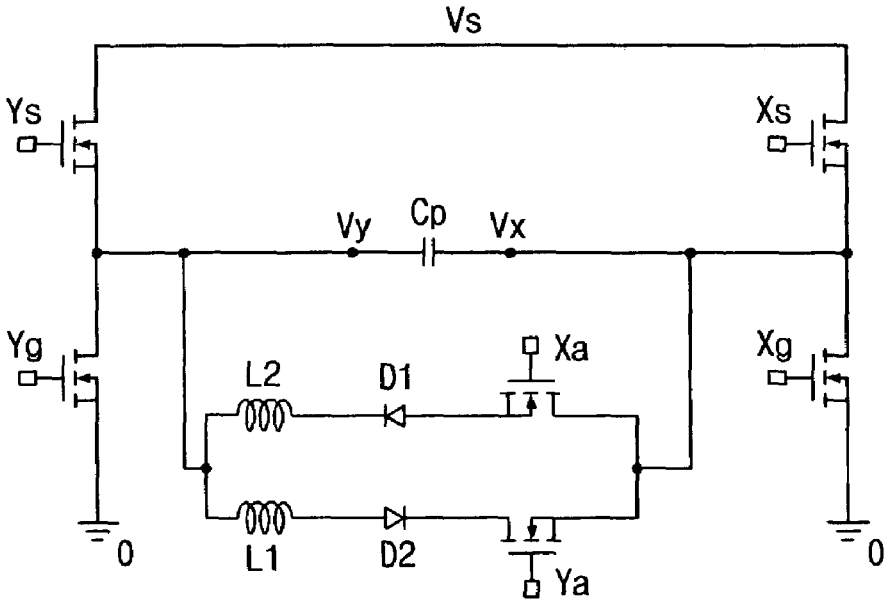
FIG. 6 shows a PDP sustain-discharge circuit according to yet another embodiment of the present invention.

Referring to FIG. 2, the flowing current in modes 1 through 3, and 5 through 7 is passed through the identical inductor. However, the current may be passed through another inductor. Referring to FIG. 6, when inductor L2 formed between the Y electrode of panel capacitor Cp and switch Xa is differentiated from inductor L1 formed between the Y electrode and switch Ya, the current flows through inductor L1 in modes 1 through 3, and the current flows through inductor L2 in modes 5 through 7.

According to the present invention, since the terminal voltage of the panel capacitor may be changed to Vs and 0V by using the energy previously charged to the inductor, the zero voltage switching is enabled, and accordingly, the stress provided to the switches is reduced. Also, the rising time and the falling time of the sustain-discharging pulses are reduced, thereby generating stable discharges. Further, since no power recovery capacitor is required, no inrush current is generated at the time of driving.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A device for driving a plasma display panel having a plurality of first electrodes and second electrodes arranged in pairs, and a panel capacitor formed between a first electrode and a second electrode, comprising:

a first switch and a second switch coupled in series between a first power source and a second power source for respectively supplying a first voltage and a second voltage, a common point of the first switch and the second switch being coupled to a first end of the panel capacitor;

a third switch and a fourth switch coupled in series between the first power source and the second power source, a common point of the third switch and the fourth switch being coupled to a second end of the panel capacitor;

an inductor coupled to the first end of the panel capacitor; and a fifth switch and a sixth switch coupled in parallel between the inductor and the second end of the panel capacitor, wherein a current is supplied to the inductor through a path formed among the first power source, the inductor, and the second power source, and voltages at both ends of the panel capacitor are concurrently changed by a resonance generated by the panel capacitor and the inductor while the current is applied to the inductor.

2. The device of claim 1, further comprising a first diode coupled between the fifth switch and the inductor, and a second diode coupled between the inductor and the sixth switch.

3. The device of claim 1, wherein a difference between the first voltage and the second voltage is a voltage needed for sustain-discharging the plasma display panel.

4. The device of claim 1, wherein the first switch, the second switch, the third switch and the fourth switch each have a body diode.

5. A device for driving a plasma display panel having a plurality of first electrodes and second electrodes arranged in pairs, and a panel capacitor formed between a first electrode and a second electrode, comprising:

an inductor coupled to a first end of the panel capacitor;

a first signal line and a second signal line for supplying a first voltage;

a third signal line and a fourth signal line for supplying a second voltage;

a first current path, formed from the first signal line to the fourth signal line through the inductor, for supplying a current in a first direction to the inductor while a first end and a second end of the panel capacitor are substantially maintained at the first voltage and the second voltage, respectively;

a second current path, formed from the first end of the panel capacitor to the second end of the panel capacitor through the inductor, for changing voltages at both ends of the panel capacitor by the current in a first direction and a resonance provided between the panel capacitor and the inductor; and a third current path formed in order of the third signal line, the inductor, and the second signal line so as to reduce the current in a first direction when the first end and the second end of the panel capacitor become the second voltage and the first voltage, respectively.

6. The device of claim 5, wherein the first end and the second end of the panel capacitor are respectively coupled to the third signal line and the second signal line when the voltages at the first end and the second end of the panel capacitor become the second voltage and the first voltage, respectively.

7. The device of claim 5, further comprising:

a fourth current path formed from the second signal line to the third signal line through the inductor for supplying a current in a second direction to the inductor while the voltages at the first end and the second end of the panel capacitor are substantially maintained at the second voltage and the first voltage, respectively, the second direction being opposite the first direction;

a fifth current path formed from the second end of the panel capacitor to the first end of the panel capacitor through the inductor, for changing the voltages at the first end and the second end of the panel capacitor by the current in a second direction and a second resonance provided between the panel capacitor and the inductor; and a sixth current path formed in order of the fourth signal line, the inductor, and the first signal line so as to reduce the current in the second direction when the voltages at the first end and the second end of the panel capacitor respectively become the first voltage and the second voltage.

8. The device of claim 7, wherein the first end and the second end of the panel capacitor are respectively coupled to the first and fourth signal lines when the first end and the second end of the panel capacitor become the first voltage and the second voltage, respectively.

9. The device of claim 5, wherein the voltage difference between the first voltage and the second voltage is a voltage necessary for sustain-discharging the plasma display panel.

10. A method for driving a plasma display panel having a plurality of first electrodes and second electrodes arranged in pairs, a panel capacitor formed between the first electrode and the second electrode, an inductor coupled to a first end of the panel capacitor, and a first power source and a second power source for respectively supplying a first voltage and a second voltage, comprising:

supplying a current in a first direction through a voltage difference between the first power source and the second power source to store a first energy when the voltages at a first end and a second end of the panel capacitor are substantially maintained at the first voltage and the second voltage, respectively;

changing the voltages at the first end and the second end of the panel capacitor to the second voltage and the first voltage respectively, by using a resonance generated in a path formed from the first end of the panel capacitor to the second end of the panel capacitor through the inductor, and using the first energy; and maintaining the first end and the second end of the panel capacitor to substantially be the second voltage and the first voltage, respectively, and recovering the energy remaining in the inductor to the first power source.

11. The method of claim 10, wherein a voltage difference between the first voltage and the second voltage is a voltage necessary for sustain-discharging the plasma display panel.

12. The method of claim 10, further comprising:

applying a current in a second direction to the inductor using the voltage difference between the first power source and the second power source to store a second energy when the first end and the second end of the panel capacitor are substantially maintained at the second voltage and the first voltage, respectively, the second direction being opposite the first direction;

changing the voltages at the first end and the second end of the panel capacitor to the first voltage and the second voltage, respectively, by using a second resonance generated in the path formed from the second end of the panel capacitor to the first end of the panel capacitor through the inductor, and using the second energy; and maintaining the voltages at the first end and the second end of the panel capacitor to substantially be the first voltage and the second voltage, respectively, and recovering the energy remaining in the inductor to the first power source.

* * * * *